United States Patent [19]

Patel

[11] Patent Number: 4,732,388

[45] Date of Patent: Mar. 22, 1988

[54] PUZZLE GAME

[76] Inventor: Narendrakumar M. Patel, 59 Deerfield Rd., Parsippany, N.J. 07054

[21] Appl. No.: 926,964

[22] Filed: Nov. 4, 1986

[51] Int. Cl.[4] ..... A63F 9/08

[52] U.S. Cl. ..... 273/153 S

[58] Field of Search ..... 273/153 S

[56] References Cited

U.S. PATENT DOCUMENTS 4,548,410 10/1985 Morrone ..... 273/153 S

OTHER PUBLICATIONS

Scientific American, Feb. 1964, pp. 122, 124, 126.

*Primary Examiner*—Anton O. Oechsle

*Attorney, Agent, or Firm*—Anthony J. Casella; Gerald E. Hespos

[57] ABSTRACT

A puzzle is provided with a frame having a generally rectangular opening therein. The rectangular opening has a major dimension of four times a selected unit of measurement, and a minor dimension of three times the selected unit of measurement. Movably disposed within the rectangular opening are four substantially identical square puzzle pieces each of which has sides equal in length to the selected unit of measurement. The puzzle further comprises three substantially identical rectangular puzzle pieces each of which has minor sides equal to the selected unit of measurement and major sides equal to twice the selected unit of measurement.

5 Claims, 2 Drawing Figures

FIG. 2
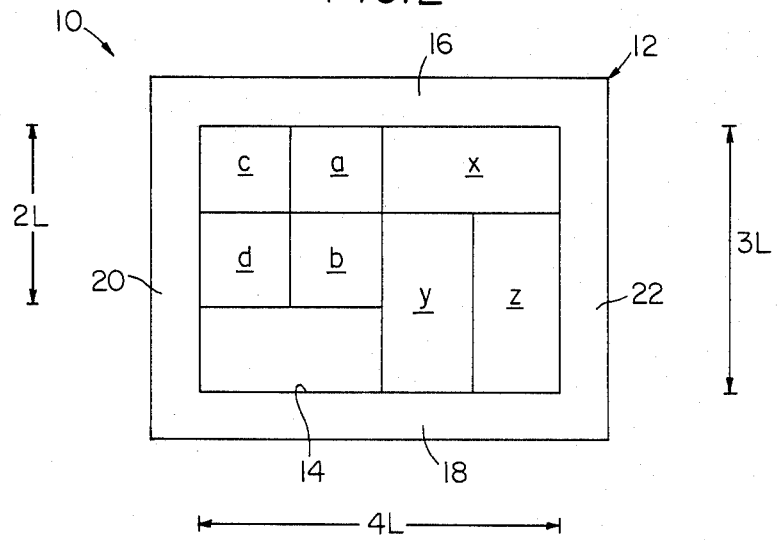
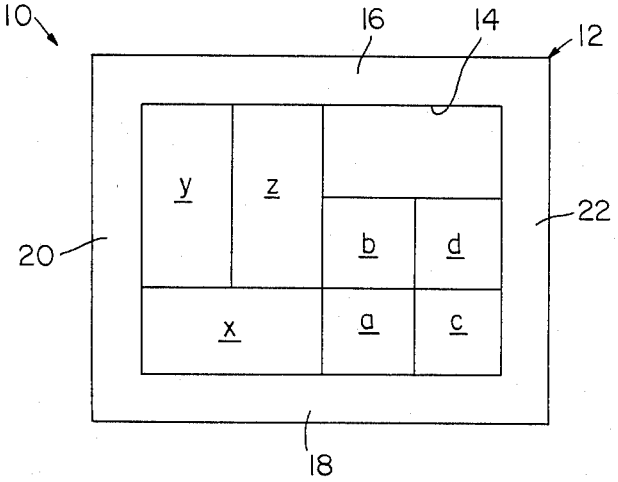
FIG. 1

PUZZLE GAME

BACKGROUND OF THE INVENTION

Many puzzles include a generally planar support, a generally rectangular frame attached to or unitary with the support and a plurality of pieces movably disposed within the frame. Typically, the area defined by the movable pieces will be smaller than the area defined by the frame. Thus, one or more empty spaces will exist in the area defined by the frame. The user of the puzzle or game sequentially moves the pieces into the one or more empty spaces thereby creating a new empty space. In this manner, the various members disposed within the frame can be moved relative to one another and relative to the frame.

In some puzzles of the general type described above, each puzzle piece disposed within the frame is provided with certain indicia, and the object of the puzzle is to sequentially move the pieces within the frame to either form an image, create a message or define some specified alphabetic or numeric order. Certain puzzles of this type employ movable pieces of different sizes and shapes. Other puzzles of this type may include one or more exits or entrances within the frame to facilitate or complicate the movement of the various pieces. On most puzzles of this type, the various puzzle pieces and the frame are formed with interlocking arrays of tongues and grooves or interlocking arrays of stepped edges to prevent the various puzzle pieces from becoming disengaged from the planar support and/or the frame. Generally larger puzzles with more pieces are easier in that they provide more room for maneuvering pieces.

It is an object of the subject invention to create an intriguing puzzle employing a plurality of pieces movably disposed within a frame.

It is another object of the subject invention to provide a puzzle having a plurality of rectangular pieces movably disposed within a rectangular frame.

Still another object of the subject invention is to provide a puzzle having a plurality of square pieces and a plurality of elongated rectangular pieces movably disposed within and elongated frame.

A further object of the subject puzzle is to provide a single puzzle having a plurality of rectangular pieces movably disposed within a rectangular frame and providing a plurality of separate puzzle games exhibiting varying degrees of difficulty and providing the user with a plurality of distinctly different challenges.

SUMMARY OF THE INVENTION

The subject invention is directed to a puzzle having a plurality of rectangular pieces movably disposed within a frame. Neither the rectangular pieces nor the frame need to be provided with indicia. Rather, the principal object of the subject puzzle is to sequentially move the rectangular pieces within the frame from a first symmetrical or logical disposition of puzzle pieces to a second symmetrical or logical disposition of puzzle pieces.

The frame of the puzzle of the subject invention defines a generally rectangular opening having an opposed pair of parallel major sides and an opposed pair of parallel minor sides. The pair of opposed parallel minor sides defined by the rectangular opening in the frame extends a distance of three times a selected unit of measurement in a first direction while the pair of opposed major sides extends a distance of four times the selected unit of measurement in a direction orthogonal to the first direction. More particularly, the opening of the frame defines an internally disposed rectangle having dimensions of three units by four units. The puzzle may further include a generally planar support panel attached to or unitary with the frame. However, it is anticipated that certain embodiments of the invention may not be provided with a generally planar support panel. In these embodiments, the frame may merely be placed upon a suitable generally planar surface, such as a table.

The puzzle further comprises four substantially identical square pieces each having four side edges extending one unit in each direction, and three substantially identical rectangular pieces each of which has minor and major side edges of one unit by two units respectively.

From the preceeding description, it is apparent that the frame defines a rectangular opening of twelve square units (three units × four units = 12 units). However, the movable pieces define a total area of only ten square units (one unit × one unit × four pieces + one unit × two units × three pieces = 10 units). From the preceeding algorithm, it is apparent that there are two square units of empty space provided in the frame of the subject puzzle. Thus, there will always be either two spaced apart square open areas having dimensions of one unit by one unit or one rectangular open area having a dimension of one unit by two units.

The puzzle enables a plurality of different starting and finishing points that can be attempted by the user. In one particular puzzle game, the puzzle pieces may initially start with the rectangular pieces disposed adjacent one longitudinal edge of the frame and the square pieces disposed at the other longitudinal end of the frame. In this game, the object may be to move the puzzle pieces such that the respective rectangular and square pieces become disposed at the opposite longitudinal ends of the frame.

The various movable pieces of the puzzle may have straight rectangular side edges without an ability to interlock with one another or with the rectangular frame. With this option, the user may readily arrange the pieces into one of the above described symmetrical or logically distributed initial dispositions. The user may then proceed to attempt to achieve a selected ending disposition of the puzzle pieces. The puzzler may also explore various options for new staring and finishing points.

BRIEF DESCRIPTION OF THE DRAWINGS

FIG. 1 is a top plan view of the puzzle game of the subject invention with the puzzle pieces disposed in a first position relative to one another.

FIG. 2 is a top plan view of the puzzle shown in FIG. 1 but with the pieces moved into a second disposition relative to one another.

DETAILED DESCRIPTION OF THE PREFERRED EMBODIMENT

The puzzle of the subject invention is indicated generally by the numeral 10 in FIG. 1. The puzzle 10 includes a frame 12 defining a generally rectangular opening 14 therein. For ease of reference herein, the frame 12 will be further defined as including opposed top and bottom major sides 16 and 18 respectively and opposed left and right minor sides 20 and 22 respectively. The reference to the top and bottom herein is provided for convenient identification terminology only, and is not intended to reflect a specific gravitational orientation of the puzzle 10.

The rectangular opening 14 in the rectangular frame 24 is dimensioned such that the distance between the opposed top and bottom major sides 16 and 18 is three times a selected units of measurement "L" or "3L" as shown in FIG. 1. Additionally, the distance between the opposed left and right sides 20 and 22 equals "4L" as shown in FIG. 1. In this context, the numerals preceeding the "L" are coefficients which indicate that the dimensions of the opening 14 in frame 12 have a predetermined dimensional ratio relative to one another. Specifically, the distance between the opposed top and bottom sides 16 and 18 is approximately 75% the distance between the opposed left and right sides 20 and 22.

The puzzle 10 further comprises a planar bottom support 24 which is unitary with the frame 12. More particularly, the frame 12 and the bottom support 24 are molded from a unitary piece of plastic. However, in other embodiments of the subject invention, the frame 12 and the planar support 24 may be formed from separate members that are securely attached to one another. In still other embodiments the frame 12 may be employed on any convenient planar surface such as a table, without an integral or unitary planar support.

The puzzle 10 further includes four substantially identical generally planar square pieces a, b, c, and d which are movably disposed within the rectangular opening 14. Each square piece a–d has side dimensions of length "L" which is equal to one fourth the distance between the left and right sides 20 and 22 and one third the distance between the top and bottom sides 16 and 18. The letters a–d shown on the figures herein is provided only for the purpose of this specification and are not indicia that are required to play the puzzle game described herein.

The puzzle 10 further includes substantially identical generally planar rectangular pieces x, y, and z which are also slidably disposed within the rectangular opening 14 of frame 12. Each rectangular piece x–z has a major side dimension of two times the selected unit of measurement "L" or "2L" and a minor side dimension of "L" as indicated in FIG. 1. Thus, each rectangular piece x–z is substantially the size of two square pieces a–d. The rectangular piece x is disposed such that its major sides are parallel to the top and bottom major sides 16 and 18 of frame 12. The rectangular pieces y and z, however, are disposed such that their respective major sides are parallel to the left and right minor sides 20 and 22 of the frame 12.

As shown in FIG. 1, the square piece c is disposed in the corner defined by sides 18 and 22 of frame 12. The square piece a is disposed adjacent piece c and adjacent the bottom side 18, while the square piece d is adjacent c and the right side 22. Square piece b is adjacent both pieces a and d. Thus, the four square pieces a–d are in the bottom right corner of frame 12. The rectangular piece x is disposed in the bottom left corner of frame 12, while rectangular pieces y and z are directly above rectangular piece x. Thus, as shown in FIG. 1, the rectangular puzzle pieces x–z are in the left half of frame 12, while the square pieces are in the right half of frame 12. By sequentially performing a plurality of moves, it is possible to create a broad array of possible distribution of puzzle pieces a–d and x–z. The FIG. 1 distribution of puzzle pieces a–d and x–z within frame 12 was selected as a starting point because of the inherent balance of this distribution and because there is more than one possible initial move for a puzzler from this starting position. By carefully analyzing and selecting a sequence of moves of puzzle pieces a–d and x–z, it is possible to achieve a distribution of puzzle pieces as shown in FIG. 2. More particularly, in this distribution, the square puzzle pieces a–d are disposed in the left half of the rectangular opening 14 of frame 12 while the rectangular puzzle pieces x–z are disposed in the right half of the rectangular opening 14. Furthermore, the disposition of puzzle pieces a–d and x–z shown in FIG. 2 precludes any subsequent moves without retracing moves that had previously been carried out.

Table 1 shows the sequence of moves to enable the puzzler to advance from the FIG. 1 distribution of puzzle pieces a–d and x–z to the FIG. 2 distribution. More particularly, the left column of Table 1 identifies the sequential number of the step to be carried out. The center column of Table 1 identifies the one or more puzzle pieces to be moved in each step and the right column of Table 1 identifies the direction of movement of those pieces. In each step set forth in Table 1 it is assumed that the puzzle pieces identified in the center column will be moved as far as possible in the direction indicated in the right column. The directional orientation set forth in Table 1 is consistent with the identification of the sides of frame 12 set forth above. More particularly, "up" refers to a movement toward the top side 16 of frame 12, while "down" refers to a movement toward the bottom side 18 of frame 12. Similarly, "left" refers to a movement toward the left side 20 of frame 12, while "right" refers to a movement toward the right side 22 of frame 12. Briefly, Table 1 shows that fifty-one properly sequenced moves will enable the puzzle to advance from the FIG. 1 distribution to the FIG. 2 distribution of puzzle pieces.

In summary a puzzle is provided including a frame having a generally rectangular opening disposed therein. More particularly, the rectangular opening in the frame defines opposed top and bottom sides of the frame and opposed left and right sides. The distance across the rectangular opening and between the opposed top and bottom sides thereof is substantially equal to three times a selected unit of measurement, whereas the distance across the rectangular opening and between the left and right sides is substantially equal to four times the selected unit of measurement. The puzzle further includes four square puzzle pieces the respective sides of which each equal the selected unit of measurement. The puzzle also includes three rectangular puzzle pieces each having a minor side dimension equal to the selected unit of measurement and a major side dimension equal to twice the selected unit of measurement. Two of the rectangular puzzle pieces have their major sides parallel to the left and right sides of the frame.

While the invention has been described relative to a preferred embodiment, it is obvious that various changes can be made without departing from the scope of the invention as defined by the appended claims.

TABLE 1

| MOVE NUMBER | PIECE(S) | DIRECTION |
|---|---|---|
| 1 | a,b,c,d | up |
| 2 | x | right |
| 3 | y,z | down |

TABLE 1-continued

| MOVE NUMBER | PIECE(S) | DIRECTION |
|---|---|---|
| 4 | b | left |
| 5 | z | up |
| 6 | x | left |
| 7 | c | down |
| 8 | a,b,z | right |
| 9 | y | up |
| 10 | x | left |
| 11 | b,z | down |
| 12 | d | left |
| 13 | a,c,z | up |
| 14 | x | right |
| 15 | b | down |
| 16 | b | left |
| 17 | d | down |
| 18 | y | right |
| 19 | b | up |
| 20 | d | left |
| 21 | d | up |
| 22 | x | left |
| 23 | c | down |
| 24 | c | left |
| 25 | a | down |
| 26 | b,y,z, | right |
| 27 | d | up |
| 28 | x | up |
| 29 | a,c | left |
| 30 | y,z | down |
| 31 | b,d | right |
| 32 | c,x | up |
| 33 | a,y | left |
| 34 | d | down |
| 35 | b | left |
| 36 | b | down |
| 37 | x | right |
| 38 | a,c,y | up |
| 39 | d | left |
| 40 | b,y | down |
| 41 | x | left |
| 42 | z | up |
| 43 | b | right |
| 44 | a,y | right |
| 45 | c | down |
| 46 | x | left |
| 47 | y | up |
| 48 | b | left |
| 49 | y,z | down |
| 50 | x | right |
| 51 | a,b,c,d | up |

What is claimed is:

1. A puzzle comprising:

a frame comprising opposed first and second major sides and opposed first and second minor sides extending between and connected to the major sides so as to define a generally rectangular opening in said frame, said rectangular opening having a major dimension measured parallel to said major sides and substantially equal to four times a selected unit of measurement, and a minor dimension measured parallel to said minor sides and being substantially equal to three times the selected unit of measurement such that a line connecting the midpoints of said major sides defines first and second halves of said opening adjacent the first and second minor sides respectively;

four substantially identical square puzzle pieces having side edges equal in length to the selected unit of measurement said square puzzle pieces being movable within the rectangular opening of said frame and being initially disposed in the first half of the rectangular opening; and three substantially identical rectangular puzzle pieces each said rectangular puzzle piece having a minor side dimension substantially equal to the selected unit of measurement and a major side dimension substantially equal to twice the selected unit of measurement, said rectangular puzzle pieces being movably disposed within said rectangular frame, two of said rectangular puzzle pieces having their major sides parallel to the minor sides of the frame and being initially disposed entirely within the second half of the opening therein, the remaining rectangular puzzle piece having its major side parallel to and adjacent one of said major sides of said frame and being initially disposed within the second half of the opening, whereby said square and rectangular puzzle pieces can be moved relative to said frame to achieve a selected distribution of said square and rectangular puzzle pieces such that said square puzzle pieces are entirely within the second half of said opening and said rectangular puzzle pieces are entirely within the first half of the opening.

2. A puzzle as in claim 1 wherein the frame is of unitary construction.

3. A puzzle as in claim 1 further comprising a generally planar support secured to said major and minor sides of said frame and substantially covering said rectangular opening therein.

4. A puzzle as in claim 3 wherein the planar support and the frame are of unitary construction.

5. A puzzle as in claim 4 wherein the frame and the planar support are formed from plastic.

* * * * *